United States Patent [19]

Stephenson

[11] 3,968,781

[45] July 13, 1976

[54] FUEL ATOMIZING DEVICE FOR CARBURETORS OF INTERNAL COMBUSTION ENGINES

[76] Inventor: Carl George Stephenson, 2052 Paulus Crescent, Burnaby, British Columbia, Canada

[22] Filed: Sept. 30, 1974

[21] Appl. No.: 510,426

[52] U.S. Cl. ..... 123/141; 48/180 R
[51] Int. Cl.² ..... F02M 29/00
[58] Field of Search ..... 123/141; 48/180 R; 261/76, 78, DIG. 48

[56] References Cited

UNITED STATES PATENTS

| | | | |
|---|---|---|---|
| 937,854 | 10/1909 | Paul | 48/180 R |
| 1,450,814 | 4/1923 | Micka | 48/180 R |
| 1,965,144 | 7/1934 | Kane et al. | 48/180 R X |
| 2,078,029 | 4/1937 | Schorsch | 48/180 R X |
| 2,721,791 | 10/1953 | Linn | 48/180 R |
| 2,889,214 | 6/1959 | Linn | 48/180 R |

*Primary Examiner*—Charles J. Myhre
*Assistant Examiner*—Ira S. Lazarus
*Attorney, Agent, or Firm*—Carver and Company

[57] ABSTRACT

A fuel atomizing device for carburetors of internal combustion engines having an annular holder adapted to be fitted inside the carburetor which supports a plurality of axially-parallel nozzles in the path of the air-fuel mixture passing the carburetor. The jet holder supports a plate therebeneath on which a plurality of upwardly opening knife-edged cups are disposed coaxially with each of the nozzles and in spaced relationship thereto so that the air-fuel mixture passing through the nozzles passes into and out of each cup as the mixture passes through to the engine manifold.

5 Claims, 4 Drawing Figures

FUEL ATOMIZING DEVICE FOR CARBURETORS OF INTERNAL COMBUSTION ENGINES

BACKGROUND OF THE INVENTION

FIELD OF THE INVENTION

This invention relates to carburetor equipped internal combustion engines and in particular to devices for atomizing the liquid fuel.

As is well known the efficiency of internal combustion engines depends, in large measure, on the effectiveness of carburetion. Carburetors are designed to provide for initial atomizing of liquid fuel and mixing with air as it passes into the carburetor air horn so as to provide for complete vapourizing of the fuel prior to the entry of the air-fuel mixture into the cylinders of the engine.

The speed of vapourizing of the fuel depends, in large measure, on the size of the droplets of the liquid fuel as it is atomized on its passage into the air stream passing through the carburetor. This fact has long been recognized and many carburetors have been fitted with a fuel atomizing and mixing device to achieve complete vapourizing and mixing.

SUMMARY OF THE INVENTION

The present invention provides a device which can be easily installed in a conventional carburetor and which, effectively, atomizes liquid fuel injected therein and obtains substantially completely uniform mixing with the entering air, prior to the passage of the air-fuel mixture into the manifold and thence, the cylinders.

The device of the present invention is relatively inexpensive to manufacture and does not depend upon extraneous power sources for its operation and does not have any moving parts so as to be substantially proof against wear or other damage.

The device of the present invention, furthermore, is capable of being installed in a carburetor with relative ease.

The atomizing and vapourizing device of the present invention includes a nozzle assembly having a circular holder adapted to be secured in an air passage of a carburetor in the path of the air-fuel mixture passing therethrough, a plurality of nozzles supported by the holder having axes parallel to the direction of flow of the air stream mixture and tapering downstream thereof, a plurality of upstream opening cups disposed in spaced relationship to each other in the path of the air-fuel mixture passing through the nozzles.

A detailed description following, related to the drawings, gives exemplification of apparatus according to the invention which, however, is capable of expression in means other than those particularly described and illustrated.

DETAILED DESCRIPTION

Figure 2:
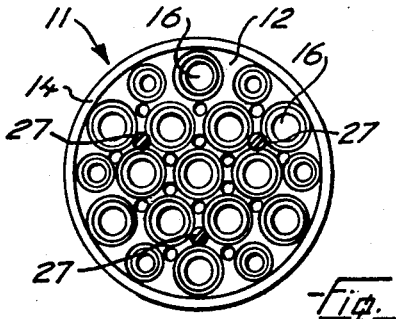
FIG. 2 is a plan view of the device.

Referring to the drawings, the atomizing device 10 has a nozzle holder, generally 11, having circular base plate 12 and an annular upstanding wall 13 the upper end of the wall terminates in an outwardly extending peripheral lip 14. A plurality of frustoconical nozzles, severally 16, are set in the base plate 12, the nozzles being arranged in axial parallelism and each tapered to a downstream discharge end 17. As shown in FIG. 2, the nozzles vary in diameter, however they can be of the same diameter, and are arranged in close proximity to each other so as to provide the greatest possible total area of opening.

Figure 4:
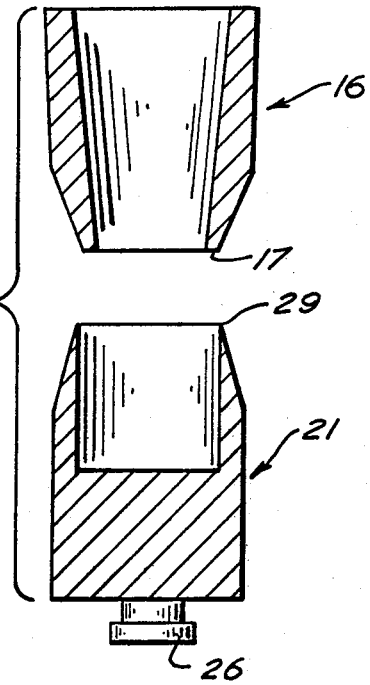
FIG. 4 is an enlarged sectional view of a nozzle and a cup.
Figure 3:
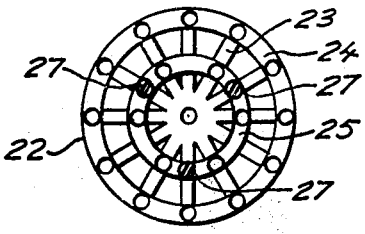
FIG. 3 is a view taken on line 3—3 of FIG. 1.

A plurality of cups, severally 21, are mounted beneath the nozzle holder 11, on a cup holder 22. The cup holder 22, as shown particularly in FIG. 3, has a plurality of spaced radiating arms 23 and connecting concentric annular braces 24 and 25 and the cups 21 which have base projections 26, see FIG. 4, which extend through the supporting rings are mounted on the cup holder in the same pattern as the nozzles are mounted on the nozzle holder.

The cup holder is mounted on machine screws, severally 27, which extend through the base plate 12 of the nozzle holder. As is evident, the cups can be spaced from the nozzles by appropriate adjustment of the machine screws. The above arrangement is also such that the cups which are knife-edged at their open ends 29 are disposed so that each cup is axially aligned with a nozzle.

For best operation of the device it is preferred that relationship of the diameter of the discharge end 17 of each nozzle to the diameter of its associated cup is in the proportion of 1/1.33 to 1/1.5 and the relationship of cup diameter to cup depth should be in the order of 1 to 1.

Figure 1:
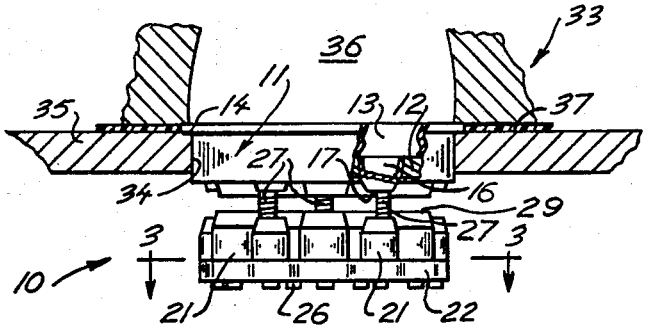
FIG. 1 is a partially sectioned elevational view of the device of the invention installed in a carburetor of an internal combustion engine, the latter being shown partially only.

FIG. 1 shows one manner in which the device 10 can be installed in a carburetor 33, shown only partially. As is common in most engines, the carburetor is bolted over an intake opening 34 of the intake manifold 35, the latter also being shown partially, so that the air passage 36 of the carburetor is aligned with the manifold intake opening. An air seal is effected between the carburetor and manifold by a gasket 37.

It will be understood that the device 10 is designed in various sizes for fitted reception of the nozzle holder within the manifold opening and with the lip 14 extending outwards of the manifold opening so that it is firmly anchored in position.

In operation the air-fuel mixture passing through the carburetor passage is divided into a plurality of jets, each one of which is directed into a cup and thence outwardly out of the cup and into the manifold and thence into the cylinders. In operation a high pitched whistle has been observed which suggests that complete atomizing of the fuel carried by the air is due, in the main, to sonic vibrations set up as the air passes over the knife-edged open upper edges of the cups. Complete mixing of the air-fuel mixture, it is considered, is due to the high turbulance effected by the impact of the jets of air-fuel mixture against the cup bottoms.

FIG. 1 shows one position of installment of the device in the carburetor of an engine, this being the preferred position as it requires no alteration of the carburetor, the carburetor gasket or the manifold. It is to be understood, however, that this is not to be considered a limitation as a carburetor can be specially constructed with the device permanently installed either ahead of or behind the throttle valve of the carburetor.

Further, although in the device as described and illustrated, the nozzles and nozzle holder are a unitary structure it will be understood that the nozzles can be simply tapered passages extending through the base plate of the nozzle holder. Consequently, the claims shall be construed accordingly.

I claim:

1. A fuel atomizing device for carburetors of internal combustion engines comprising:

a. a plurality of tapered nozzles, b. means for securing said nozzles in axial parallelism with each other in the air passage of the carburetor so that the air/fuel mixture passing through said passage passes through said nozzles and issues a plurality of jets from said nozzles, c. a plurality of cylindrical cups having knife-edged open ends and being equal in number to said nozzles, each cup being located so that each said cup is spaced downstream of the discharge end of an associate nozzle and has its open end opening toward said associated nozzle, d. each of said cups being axially aligned with its associated nozzle and being spaced downstream from its associated nozzle for receiving the jet of air/fuel mixture issuing from its associated nozzle.

2. A device as claimed in claim 1 in which the diameter of each cup is between 1.33 and 1.5 times greater than the diameter of the discharge end of each nozzle with which each cup is associated.

3. A fuel atomizing device in combination with the carburetor of an internal combustion engine comprising:

a. a nozzle holder adapted for fitted reception in an intake opening of said intake manifold, the nozzle holder having a base plate, an upstanding side wall and a peripheral lip extending outwardly from the side wall, b. a plurality of tapered nozzles extending through the base plate so that the air/fuel mixture leaving said carburetor passes into the manifold through the downstream end of the nozzles as a plurality of jets, c. a cup holder secured to said nozzle holder downstream of said nozzles, d. a plurality of cylindrical cups, equal in number to said nozzles opening toward said nozzles having knife-edged open ends, secured to said cup holder and disposed in spaced relationship to each other for receiving the jets of air/fuel mixture issuing from said nozzles, each cup being located so that the open end of each cup is spaced downstream of the discharge end of an associated nozzle and axially aligned therewith.

4. A device as claimed in claim 3 in which the diameter of each cup is between 1.33 and 1.5 times greater than the diameter of the discharge end of each nozzle with which each cup is associated.

5. A device as claimed in claim 3 in which the cup holder is suspended from the nozzle holder on screws extending through the nozzle holder for adjustably spacing the cups from the nozzles.

* * * * *